US007208048B2

(12) United States Patent
Eastaughffe

(10) Patent No.: US 7,208,048 B2
(45) Date of Patent: Apr. 24, 2007

(54) CONTINUOUS CENTRIFUGE

(75) Inventor: Gordon Francis Eastaughffe, Acacia Ridge (AU)

(73) Assignee: WDT (Engineers) Pty. Ltd. (AU)

( * ) Notice: Subject to any disclaimer, the term of this patent is extended or adjusted under 35 U.S.C. 154(b) by 212 days.

(21) Appl. No.: 10/493,026

(22) PCT Filed: Oct. 15, 2002

(86) PCT No.: PCT/AU02/01399

§ 371 (c)(1),
(2), (4) Date: Apr. 19, 2004

(87) PCT Pub. No.: WO03/033163

PCT Pub. Date: Apr. 24, 2003

(65) Prior Publication Data

US 2004/0245325 A1 Dec. 9, 2004

(30) Foreign Application Priority Data

Oct. 18, 2001 (AU) ..... PR8347
Dec. 7, 2001 (AU) ..... PR9396

(51) Int. Cl.
*B04B 3/00* (2006.01)
*B04B 11/02* (2006.01)
*C13F 1/06* (2006.01)

(52) U.S. Cl. ..... 127/19; 127/9; 210/369; 210/377; 210/380.1; 494/36; 494/60

(58) Field of Classification Search ..... 494/36, 494/60; 210/369, 377, 380.1; 127/9, 19
See application file for complete search history.

(56) References Cited

U.S. PATENT DOCUMENTS

| | | | |
|---|---|---|---|
| 3,108,067 | A | 10/1963 | Dietzel et al. |
| 4,131,482 | A | 12/1978 | Dietzel |
| 4,762,570 | A | 8/1988 | Schaper |

FOREIGN PATENT DOCUMENTS

| | | |
|---|---|---|
| DE | 2364260 | 6/1975 |
| EP | 625374 | 11/1994 |
| EP | 1084754 | 3/2001 |
| GB | 9118386 | 2/1963 |
| JP | 08294645 | 11/1996 |
| RU | 2155231 | 8/2000 |
| SU | 1061844 | 12/1983 |

*Primary Examiner*—David A. Reifsnyder
(74) *Attorney, Agent, or Firm*—Stites & Harbison PLLC; Marvin Petry

(57) ABSTRACT

A continuous centrifuge (10) has a basket (30) with upper and lower basket portions (43, 44) separated by an intermediate slip portion (45). The lower basket portion (43) has an included angle of 40–50°, to separate "green" molasses from the sugar crystals, while the upper basket portion (44) has an included angle of 50–60°, to separate washed molasses from the sugar crystals. The inner faces of the walls of the basket portions (43, 44) have radial drainage grooves (46), closed at their lower ends and opens at their upper ends, to discharge the molasses.

12 Claims, 2 Drawing Sheets

CONTINUOUS CENTRIFUGE

BACKGROUND OF THE INVENTION

1. Field of the Invention

This invention relates to a continuous centrifuge.

The invention also relates to a basket for the centrifuge.

The invention particularly relates, but is not limited to, a continuous centrifuge (and centrifuge basket therefore) for separating sugar crystals from viscous masses such as molasses or massecuites, while being processed in centrifuges in the production of the sugar crystals.

Throughout the specification, the term "centrifuge" shall also include "centrifugal machine" and "fugal".

2. Prior Art

In recent years, continuous centrifuges have started to replace batch centrifuges. One reason for this is that the power demands for the continuous centrifuges are more evenly distributed than the "peak" power demands of the batch centrifuges. This enables the capital and operating costs for power supply and transmission equipment to be reduced significantly.

The purging of massecuites in centrifuges has two distinctly separate steps. The first step is the initial removal of all excess molasses and "free" surface molasses from the sugar crystals. The second step is the final washing and partial drying of the crystals before discharge of the crystals from the centrifuge basket. These two steps are presently done with centrifugal single section baskets.

Conventional continuous centrifuges have been proposed with two separate centrifuge baskets. The massecuite feed is directed to a first (upper) basket (for the removal of the "green" molasses) and the resultant sugar crystal/molasses mixture is directed (via deflection means) to a second (lower) basket for the washing of the remaining molasses from the sugar crystals.

When separating the sugar crystals from the massecuites, it is a major objective to minimise the damage to the sugar crystals. The damaged or broken crystals are re-mixed with the molasses/water liquor and must be recrystallised, which is inefficient.

The feeding of the massecuites to the first basket; and the transfer to the second basket, with resultant impacts of the sugar crystals with the baskets and deflection means within the centrifuge, increases the likelihood of damage to the sugar crystals.

The likelihood of damage due to the impacts is increased due to the high gravitational forces within the centrifuge, eg., in the order of 300–1000G. Such high forces are required to cause the molasses to pass through the stainless steel screens in the basket(s) and to be expelled via the drainage holes in the basket(s).

The power demands of the known continuous centrifuges are still relatively high as the baskets must be driven at, eg., 700–2000 rpm to generate the high gravitational forces discussed above. The high power demands at high speed are due to the fact that continuous centrifuge power is proportional to $(\text{speed})^{1.8\ to\ 2.0}$.

SUMMARY OF THE PRESENT INVENTION

It is an object of the present invention to provide a continuous centrifuge which can provide effective separation of the sugar crystals from the massecuites at lower gravitational levels.

It is a preferred object of the present invention to provide such a continuous centrifuge which can be operated at lower basket rotational speeds; and thereby with lower power demand.

It is a further preferred object of the present invention to provide a two-stage centrifuge basket as an integral unit.

It is a still further preferred object of the present invention to provide a centrifuge basket which enables separation of the molasses from the sugar crystals at lower gravitational force ranges.

It is a still further preferred object to provide a continuous centrifuge where the impact damage to the discharged sugar crystal(s) is reduced by the aforesaid lower rotational speed.

It is a still further preferred object to provide a continuous centrifuge where the incoming massecuite can be "conditioned" by mixing with recycled "green" molasses.

It is a still further preferred object to provide a continuous centrifuge where the volume of wash water added to the molasses is reduced.

It is a still further preferred object to provide a continuous centrifuge where massecuite is washed on the screen by recycled molasses/water.

It is a still further preferred object to provide an internal surface to the centrifuge basket which creates low pressure zones on the internal centrifuge basket surface.

Other preferred objects of the present invention will become apparent from the following description.

In one aspect, the present invention resides in a continuous centrifuge, including:

a centrifuge housing;

a centrifuge basket rotatably mounted in the housing and driven by drive means;

a massecuite inlet to feed massecuites to the centrifuge basket;

at least one molasses outlet; and a sugar outlet; wherein:

the centrifuge basket has a first portion operable to separate "green" molasses from the sugar crystals and a second portion operable for separation of the washed sugar crystals from the molasses; and at least one of the portions of the centrifuge basket has screen means overlying substantially radially extending drainage grooves in the wall of the basket to develop low pressure zones to enable the molasses to be more readily expelled from the sugar crystals via gravitational force.

The massecuite fed to the centrifuge basket may be conditioned by mixing with recycled "green" molasses.

Preferably, the centrifuge basket is mounted on a shaft rotatably journalled within the housing and is operably connected to the output shaft of a drive motor (forming the drive means) by a suitable coupling which preferably dampens any vibrations between the basket and the drive motor.

Preferably, the first, lower portion of the basket receives the massecuite from the massecuite inlet via an accelerator, the lower portion having an inclined side wall inclined at an angle, eg., in the range of 15–20° to the vertical (ie. included angle 40–50°). Preferably, the second, upper portion has an inclined side wall inclined at an angle of 20–30° to the vertical (ie. an included angle 50–60°), where the lower and upper portions are connected by an intermediate "step" portion.

Preferably, the conditioning of the massecuite by the mixing with "green" molasses is effected in an initial accelerating cone of the accelerator.

Preferably, the conditioned massecuite is accelerated to the basket rotational speed prior to transfer to the screen means in the basket.

Preferably the side walls of the walls of the upper and lower portion of the basket have respective screens overlying respective drainage grooves, the drainage grooves being open to the respective upper ends of the side walls. The arrangement of the stainless steel screens and drainage grooves will be described hereinafter in more detail.

Preferably, the recirculating molasses is sprayed onto the screen of the lower portion; and wash water is sprayed onto the screen of the upper portion.

Preferably, the "green" molasses, separated from the sugar crystals in the lower portion of the basket, is collected in the housing and discharged through a green molasses outlet. At least a portion of the green molasses can be directed to the accelerator to condition the incoming massecuite.

Preferably, the washed molasses, separated from the sugar crystals in the upper portion of the basket, is collected in the housing and discharged through a washed molasses output. At least a portion of the washed molasses is used as recirculating molasses and can be sprayed onto the screen of the lower portion.

Preferably, the washed sugar crystals are also collected in the housing and discharged out the sugar outlet.

Preferably, the drive motor rotates the basket at a rotational speed of, eg., 300–350 rpm, to generate gravitational forces in the range of 75–140 G. (The upper and lower limits may be varied to suit the particular massecuites being processed.)

In a second aspect, the present invention resides in a centrifuge basket for a continuous centrifuge including:

at least one wall portion having a plurality of substantially radially extending drainage grooves on an inner surface of the wall and extending upwardly to a discharge portion at or adjacent the top of the wall (or wall portion);

a screen overlying the drainage grooves, having holes or slots therethrough to enable the molasses to be separated from the sugar crystals in the massecuite;

and means spacing and supporting the screen above the drainage grooves to enable the molasses to pass through the holes or slots in the screen and enter the drainage grooves; so arranged that the drainage grooves develop low pressure zones to enable the molasses to be more readily expelled from the sugar crystals via gravitational force.

For the centrifugal basket of the continuous centrifuge hereinbefore described, both the lower and upper portions of the basket will be provided with respective drainage grooves, screens and spacing means.

BRIEF DESCRIPTION OF THE DRAWINGS

To enable the invention to be fully understood, a preferred embodiment will now be described with reference to the accompanying drawings, wherein.

DETAILED DESCRIPTION OF THE INVENTION

Figure 1:
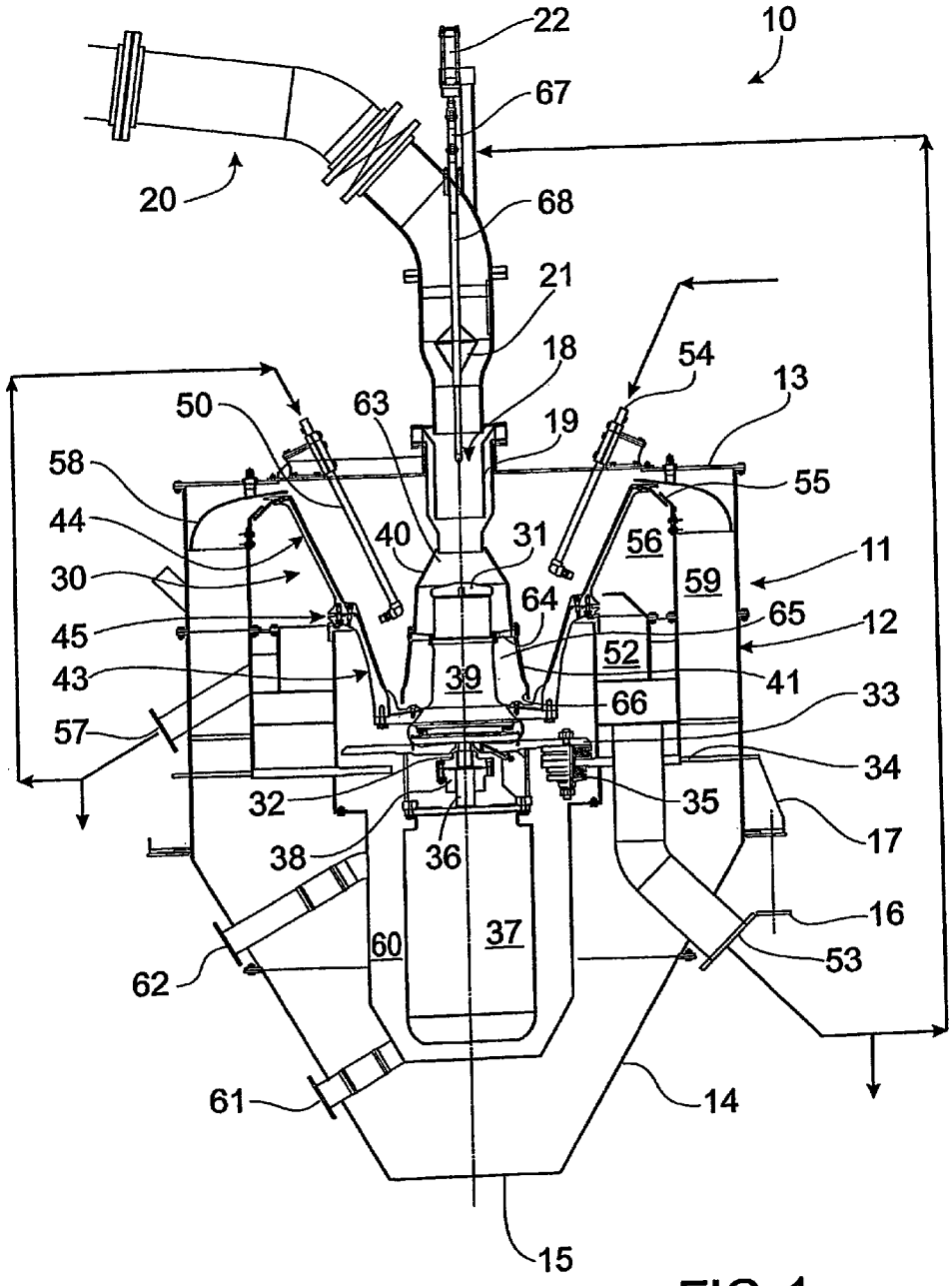
FIG. 1 is a schematic sectional side view of a continuous centrifuge in accordance with the present invention.

Referring to FIG. 1, the continuous centrifuge 10 has a housing 11 with a substantially cylindrical side wall 12, a removable top wall 13, and a frusto-conical lower wall 14 with a sugar crystal discharge outlet 15. The housing 11 is mounted on a suitable structure 16 via mounting brackets 17.

A massecuite inlet 18 is provided centrally in the top wall 13 and is heated by a steam jacket 19, to control the temperature, and thereby the viscosity, of the massecuite fed to the centrifuge 10.

A massecuite feed pipe 20 has a flow control valve 21, controlled by a pneumatic ram 22, to control the flow of massecuite to the centrifuge 10. A current sensor, not shown, measures the power demand of the drive motor (to be hereinafter described), and is connected to the pneumatic ram 22 to increase the massecuite flow as the current level drops.

The centrifuge basket 30, to be hereinafter described in more detail, is rotationally mounted substantially centrally in the housing 11, about a rotary support member 31, in turn provided at the upper end of a basket drive shaft 32 journalled in suitable bearings (not shown) in a centre support 33, mounted on an internal housing wall 34 on damped mountings 35.

The basket drive shaft 32 is coupled to the motor output shaft 36 of an electric drive motor 37 via a damped coupling 38.

The basket 30 has an inner wall 39, which depends from the rotary support member 31, to form an annular space with upper and lower accelerating cones 40, 41 to direct the massecuite to the bottom of the basket 30. NB: The accelerating cones 40, 41 are mounted on, and rotate with, the inner wall 39 of the basket 30; and the small distance between the lower end of the lower accelerating cone 41 and the adjacent side wall of the basket 30 minimises the impact of the crystals on the side wall of the basket 30.

The bottom wall 42 of the basket 30 is profiled to generate a smooth flow of massecuite into the basket 30 for separation of the sugar crystals from the molasses.

The basket 30 has a lower basket portion 43 for the separation of the "green" molasses, and upper portion 44 for the separation of the washed molasses from the sugar crystals; the portions being connected by an intermediate "step" portion 45.

Figure 2:
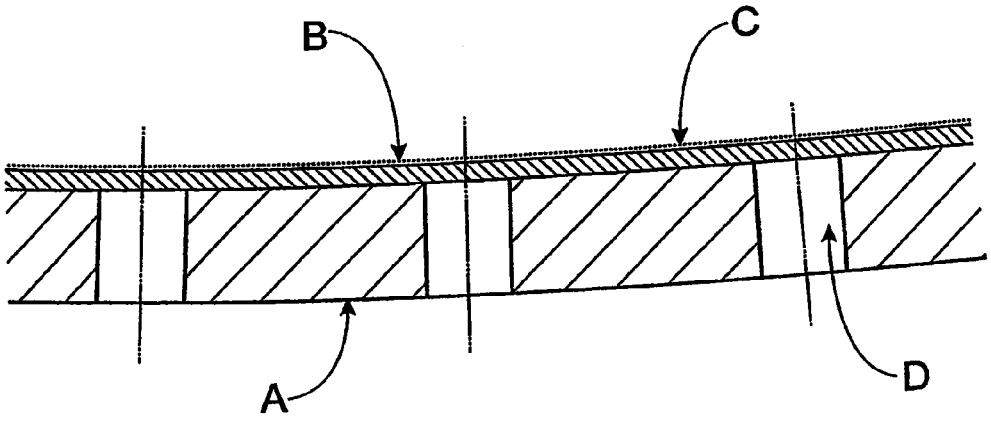
PRIOR ART FIG. 2
FIG. 2 is a sectional plan view of a basket section of a conventional continuous centrifuge basket.

As shown in FIG. 2, a conventional continuous centrifuge basket section A has a stainless steel screen B and woven wire backing C overlying radial drainage holes D to allow the molasses to be separated from the sugar crystals.

Figure 3:
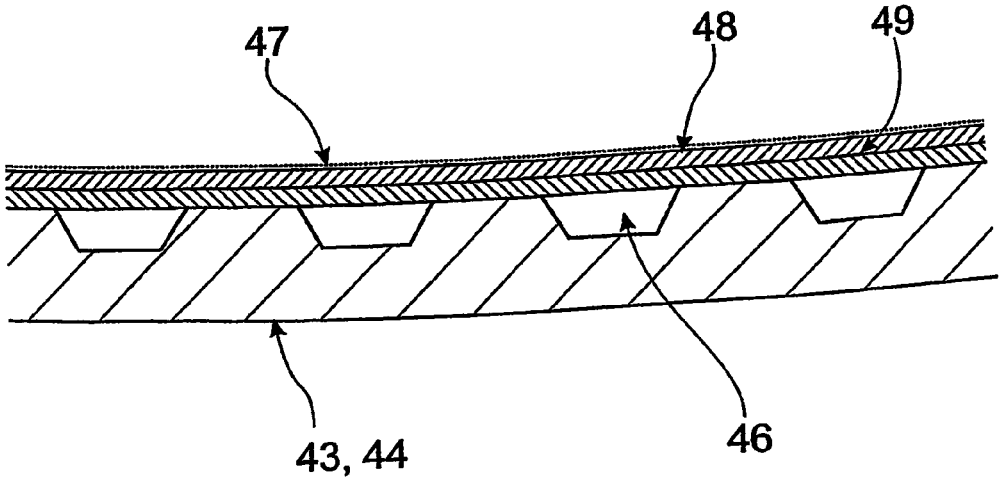
FIG. 3 is a similar sectional view of a basket section in accordance with the present invention.

Unlike the conventional continuous centrifuge basket section shown in FIG. 2, the lower and upper basket portions 43, 44 have the sectional profile shown in FIG. 3. Backwardly inclined radial drainage grooves 46, closed at their lower ends, are provided in the inner face of the wall (or sheet) of the basket portions 43, 44 and are open at their upper ends to discharge the molasses received therein.

The stainless steel screen 47, eg., with preferably 120 micron slots, is spaced from the grooves 46 by a woven wire backing 48 laid over a perforated sheet support plate 49. (NB: The purpose of the backwardly inclined radial drainage grooves 46 is to cause the inner surface of the basket portion(s) 43, 44 to act as a mixed flow centrifugal pump impellor(s) and cause the formation of a low pressure zone generally free of molasses immediately behind the stainless steel screen 47 and its supports 48 and 49.)

In tests carried out on the basket construction shown in FIG. 3, the molasses can be separated from the sugar crystals under gravitational loads as low as 75–140 G; whereas the standard construction of FIG. 2 requires gravitational loads of 300–700 G.

With the basket construction of FIG. 3, the molasses can more easily flow through the stainless steel screen 47 to the drainage grooves 46 and thereby to a collection chamber(s) to be hereinafter described.

At least one spray nozzle 50 sprays recirculated molasses and water being some portion of that molasses and water discharged from the upper basket portion 44 onto the stainless steel screen 47 of the lower basket portion 43 and the "green" molasses is discharged from the upper ends of the radial grooves through a passage(s) or port(s) 51 to a "green" molasses collection chamber 52, from which the "green" molasses flows through a green molasses discharge pipe 53.

The sugar crystals/molasses then flows over the stainless steel screen 47 of the upper basket portion 44 and the crystals are washed by water from water nozzle(s) 54 directed onto the screen 47.

NB: It will be noted that the upper basket screen 47 is inclined at a greater angle, eg., 25° to the vertical, than the lower basket screen 47 which is inclined at, eg., 18°. The increase in angle, and increase in major diameter of the upper basket results in higher gravitational and radial flow forces on the sugar crystals/molasses to overcome the high viscosity and frictional co-efficient of the mixture in the upper basket 44. The angles are selected to ensure that the flow of sugar crystals/molasses over the upper and lower stainless steel screens 47 will continue to their normal discharge points if the inflow of massecuite to the centrifuge 10 is interrupted until all available sugar/molasses discharge is completed.

The "washed" molasses (and water) is discharged through passage(s)/port(s) 55 at the top of the upper basket portion 44 into a molasses collection chamber 56 for discharge via a wash molasses outlet pipe 57.

A deflection plate 58 directs the washed sugar crystals to a crystal collection chamber 59 for discharge through the sugar crystal discharge outlet 15.

Due to the relatively low discharge velocity of the sugar crystals, the impact damage on contact with the deflection plate 58 is minimised.

To keep the drive motor 37 within its operating temperature range, cooling air is pumped through the motor housing 60 via an inlet pipe 61 and outlet pipe 62.

The construction of the basket portions 43, 44 with the drainage grooves 46, enables the molasses to be separated at low gravitational loads, and thereby low power demands for the centrifuge; while further permitting the two separating stages to be effected in the basket portions 43, 44 provided in an integrated basket 30.

In conventional continuous centrifuges, conditioning of the massecuite, by bending with molasses and/or water, is effected external to the centrifuges. With the present invention, such conditioning, where the massecuite is mixed with recycled "green" molasses can be effected internally. The accelerating cones 40, 41 can be used to effect the process function of conditioning the massecuite by blending the mixture of incoming massecuite and recycled green molasses within the centrifuge to provide a more easily purged massecuite.

The conditioning effect on the massecuite by the accelerating cones 40 and 41 improves the even distribution of the massecuite on the centrifugal screen and is a major factor in the better purging of the massecuite on the centrifugal screen.

The operation of the massecuite conditioning is as follows.

The incoming streams of massecuite and molasses or water enter a chamber 63 formed by the upper accelerating cone 40. On contact with the accelerating cap 31, the streams of massecuite and molasses or water are deflected by inertia to the inner surface of the upper accelerating cone 41 and the massecuite. and molasses or water are accelerated to approximately the rotational speed of the centrifuge.

The upper accelerating cone 40 increases in diameter towards its lower end and facilitates the flow of the mixture of massecuite, molasses or water in a downwards direction.

The lower surface of the chamber 63 is formed by the upper portion of the lower accelerating cone 41. This portion of the lower accelerating cone 41 includes shaped angled openings 64 which act to divide the flow of massecuite, molasses and water into several separate streams. These streams are re-combined in entry to the chamber 65 formed by the lower accelerating cone 41.

The lower accelerating cone 41 is shaped to cause the mixture of massecuite, molasses or water to further mix by means of profile changes as at 66 before discharging the massecuite in a conditioned form to the lower centrifuge basket 43.

The split-cycle operation of the present invention enables the amount of wash water added to the centrifuge to be reduced.

A major problem in regard to the operation of other continuous centrifuges has been that in other cases, continuous centrifuges and considerably more wash water to the molasses discharge than do batch centrifuges. The ability to separate the two molasses stream ("green" and "wash") in the centrifuge design of the present invention enables a reduced quantity of wash water to be added, in that both the initial conditioning of the massecuite and the initial washing of in the basket are done using re-cycled molasses. The reduction in water addition to the molasses from centrifugals reduces the evaporation workload of the crystallisation section of the sugar factory.

In addition, the "counter-flow" of washings to the massecuite flow reduces the dissolution (and loss of sucrose to the molasses stream) of the crystal within the massecuite.

The operation within the centrifuge is carried out as follows.

A portion of the "green" molasses discharged from the outlet 53 is recycled to the probe molasses feed 67 and passes via a hollow pipe 68 to the incoming massecuite below the valve 21. This, together with any water which can also be added at 67 is mixed with the massecuite within the centrifuge before entry to the lower basket 43.

Wash water is added to the upper basket through the spray 54. A portion of the molasses and wash water mixture discharged through the wash molasses outlet 57 (via spray nozzle 50) is sprayed to the upper section of the lower basket 43 to commence the washing process and facilitate flow of sugar crystal to the upper basket 44.

Various changes and modifications may be made to the embodiments described and illustrated without departing from the present invention as claimed.

The invention claimed is:

1. A continuous centrifuge, including:

a centrifuge housing;

a centrifuge basket rotatably mounted in the housing and driven by drive means;

a massecuite inlet to feed massecuites to the centrifuge basket;

at least one molasses outlet; and a sugar outlet; wherein:

the centrifuge basket has a first portion operate to separate green molasses from sugar crystals in the massecuite and a second portion operable for separation of washed sugar crystals from remaining molasses and waste water, and the centrifuge basket has screen means overlying substantially radially extending drainage grooves in a side wall of the basket, the drainage grooves being closed at lower ends and open to an upper end of the side wall, the develop low pressure zones to enable the molasses to be more readily expelled from the sugar crystals via a generated centrifugal force.

2. The centrifuge as claimed in claim 1, wherein at least one accelerating core in the centrifuge basket is adapted to condition the massecuite fed to the centrifuge basket by mixing the massecuite with previously separated green molasses.

3. The centrifuge as claimed in claim 2, wherein at least a portion of molasses discharged from the upper portion is sprayed onto the screen of the lower portion.

4. The centrifuge as claimed in claim 1, wherein the centrifuge basket is mounted on a shaft-rotatably journalled within the housing and is operably connected to an output shaft of a drive motor, forming a drive means, by a coupling which dampens any vibrations between the basket and the drive motor.

5. The centrifuge as claimed in claim 4, wherein the drive motor rotates the basket at a rotational speed of 300–350 rpm, to generate centrifugal forces in the range of 75–140 G.

6. The centrifuge as claimed in claim 1, wherein a lower portion of the basket receives the massecuite from the massecuite inlet via an accelerator, the lower portion having an inclined side wall inclined at an angle in the range of 15–20° to the vertical; an upper portion has an inclined side wall inclined at an angle of 20–30° to the vertical; and where the lower and upper portions are connected by an intermediate portion.

7. The centrifuge as claimed in claim 6, further comprising an initial accelerating cone of the accelerator, said initial accelerating cone for conditioning the massecuite by mixing the massecuite with green molasses.

8. The centrifuge as claimed in claim 6, wherein the inclined side walls of the upper and lower portions of the basket have respective screens overlying respective drainage grooves, the drainage grooves being open to respective upper ends of the side walls.

9. The centrifuge as claimed in claim 1, wherein green molasses, separated from sugar crystals in the lower portion of the basket, is collected in the housing and discharged through a green molasses outlet, and at least a portion of the green molasses is directed to the accelerator to condition incoming massecuite.

10. The centrifuge as claimed in claim 9, wherein washed molasses, separated from the sugar crystals in the upper portion of the basket, is collected in the housing and discharged through a washed molasses output, and at least a portion of washed molasses is directed to the lower portion of the basket to wash the massecuite.

11. The centrifuge as claimed in claim 10, wherein washed sugar crystals are collected in the housing and discharged out the sugar outlet.

12. A centrifuge basket for a continuous centrifuge including at least one side wall having a plurality of substantially radially extending drainage grooves on an inner face of the side wall, the drainage grooves being closed at lower ends and extending upwardly to a discharge portion at or adjacent to the top of the side wall; a screen overlying the drainage grooves, having holes or slots therethrough to enable molasses to be separated from sugar crystals in the massecuite; and means spacing and supporting the screen above the drainage grooves to enable the molasses to pass through the holes or slots in the screen and enter the drainage grooves; so arranged that the drainage grooves develop low pressure zones to enable the molasses to be more readily expelled from the sugar crystals via centrifugal force.

* * * * *